US009018964B2

(12) United States Patent
Furukawa

(10) Patent No.: US 9,018,964 B2
(45) Date of Patent: Apr. 28, 2015

(54) POWDER SENSOR

(71) Applicant: TDK Corporation, Tokyo (JP)

(72) Inventor: Nobuo Furukawa, Tokyo (JP)

(73) Assignee: TDK Corporation, Tokyo (JP)

( * ) Notice: Subject to any disclaimer, the term of this patent is extended or adjusted under 35 U.S.C. 154(b) by 178 days.

(21) Appl. No.: 13/710,554

(22) Filed: Dec. 11, 2012

(65) Prior Publication Data

US 2013/0154610 A1 Jun. 20, 2013

(30) Foreign Application Priority Data

Dec. 19, 2011 (JP) ..... 2011-277361

(51) Int. Cl.
*G03G 15/08* (2006.01)

(52) U.S. Cl.
CPC ..... *G03G 15/0824* (2013.01)

(58) Field of Classification Search
CPC ..... B41J 2002/17583; B41J 2/17566; B41J 2/17513; B41J 2/17546; G01F 23/22; G01F 1/76; G01F 23/263; G01F 23/2966; G03G 15/0829; G03G 15/0147; G03G 15/0825; G03G 15/0827; G03G 15/0831; G03G 15/1605; G03G 15/5004; G03G 15/80; G03G 15/0824; G03G 15/0849; G03G 15/086
USPC ..... 324/711, 76.49, 600, 464, 71.4, 76.46, 324/76.41, 520, 633, 727, 76.39, 77.1, 683, 324/76.52, 76.77, 521, 617
See application file for complete search history.

(56) References Cited

U.S. PATENT DOCUMENTS

| | | | | |
|---|---|---|---|---|
| 3,953,844 | A * | 4/1976 | Barr et al. | 340/627 |
| 5,247,751 | A * | 9/1993 | Ohya et al. | 33/561 |
| 5,438,393 | A | 8/1995 | Komatsu et al. | |
| 2006/0064267 | A1 * | 3/2006 | Sugiura | 702/117 |

FOREIGN PATENT DOCUMENTS

| | | |
|---|---|---|
| JP | 3-37592 A | 2/1991 |
| JP | 6-27065 A | 2/1994 |
| JP | 6-59049 A | 3/1994 |

(Continued)

OTHER PUBLICATIONS

Maching Translation of JP 2928273 B2, Title: Powder Sensor, Inventors: Wada Takashi and Sasaki Kaoru, Date: Aug. 3, 1999.*

*Primary Examiner* — Arleen M Vazquez
*Assistant Examiner* — Lee Rodak
(74) *Attorney, Agent, or Firm* — Leydig, Voit & Mayer, Ltd.

(57) ABSTRACT

A powder sensor includes a piezoelectric element, an oscillator circuit, a first square wave signal generator, a second square wave signal generator, and a phase judgment circuit. The oscillator circuit applies to the piezoelectric element an output signal having a frequency equal to or near a resonance frequency of the piezoelectric element. The first square wave signal generator generates a first square wave signal by converting a terminal voltage of the piezoelectric element. The second square wave signal generator generates a second square wave signal that transits from an initial level to a detection level when the first square wave signal rises or falls in a detection period and that does not transit outside of the detection period. The detection period is a part of each cycle of the output signal of the oscillator circuit. The phase judgment circuit determines phase of the second square wave signal.

5 Claims, 8 Drawing Sheets

(56) References Cited

FOREIGN PATENT DOCUMENTS

| | | | | | |
|---|---|---|---|---|---|
| JP | 6-160266 | A | | 6/1994 | |
| JP | 6-167437 | A | | 6/1994 | |
| JP | 2928273 | B2 | * | 8/1999 | ..... G01G 3/16 |
| JP | 2011-27778 | A | | 2/2011 | |
| JP | 2011-112447 | A | | 6/2011 | |

* cited by examiner

POWDER SENSOR

BACKGROUND OF THE INVENTION

1. Field of the Invention

The present invention relates to a powder sensor for detecting powder such as photocopier toner.

2. Description of the Related Art

Toner used in a photocopier for example is more consumed according as the number of photocopies increases and hence the remaining amount thereof needs to be detected at all times so that toner is newly supplied if the remaining amount reduces to a proper amount. A powder sensor is known that detects the presence/absence of the powder for this end.

The powder sensor of Japanese Laid-Open Patent Publication No. 3-37592 includes a powder sensor element (two-terminal piezoelectric element), a sweep oscillator circuit connected via a resistor to an input of the powder sensor element, a phase comparison unit that performs a phase comparison between a terminal voltage of the powder sensor element and a drive pulse signal from the sweep oscillator circuit, and a phase discrimination unit that discriminates the result of this comparison to detect the presence/absence of the powder. Specifically, a detected phase difference is latched into a register e.g. as level 0 when it is 80° to 90° and as level 1 when 0° to 10° based on a previously set threshold value of 45°, to output a detection signal as a digital signal depending on the presence/absence of the powder.

The conventional detection method brings about no problem in the common environment. However, in a particular environment, e.g., in case a large vibration or shock is applied due to assembly, adjustment, or other factors of a photocopier, the conventional detection method may cause a temporary shift in the phase of the terminal voltage of the powder sensor element because of noise on the terminal voltage, which may result in an misjudgment that powder is absent regardless of the presence of powder depending on the extent of the shift. With the progress of size reduction in OA equipment such as the photocopier, the powder sensor element becomes susceptible to the influence of a vibration originating from a motor in the paper feed, which may be a cause of the misjudgment.

SUMMARY OF THE INVENTION

The present invention has been made in view of the foregoing circumstances and problems, and an object thereof is to provide a powder sensor capable of reducing or eliminating a misjudgment that may occur when a vibration or shock is applied, as compared with the prior art.

In an aspect of the present invention, a powder sensor includes a piezoelectric element, an oscillator circuit, a first square wave signal generator, a second square wave signal generator and a phase judgment circuit. The oscillator circuit applies to the piezoelectric element an output signal having a frequency equal to or near a resonance frequency of the piezoelectric element. The first square wave signal generator generates a first square wave signal by converting a terminal voltage of the piezoelectric element. The second square wave signal generator generates a second square wave signal that transits from an initial level to a detection level when the first square wave signal rises or falls in a detection term and that does not transit from the initial level to the detection level when the first square wave signal rises or falls in a term out of the detection term, wherein the detection term is a part of each cycle of an output signal of the oscillator circuit. The phase judgment circuit judges a phase of the second square wave signal.

The powder sensor may include a clear signal generator that generates a clear signal and input the clear signal to the second square wave signal generator to set the second square wave signal to the initial level before beginning of the detection term of a next cycle.

The second square wave signal generator may include an edge trigger type flip-flop whose clock input is the first square wave signal.

A D-input of the flip-flop may be a detection term limiting signal that is a first level in the detection term and is a second level in a term out of the detection term.

The output signal of the oscillator circuit applied to the piezoelectric element may be utilized as the detection term limiting signal.

The powder sensor may include a powder presence/absence judgment circuit that judges whether powder is present or absent based on the result of a judgment in the phase judgment circuit. And the powder presence/absence judgment circuit may make a judgment that powder is absent if the phase judgment circuit detects n (where "n" is an arbitrary integer satisfying $n \geq 2$) consecutive times that the phase of the second square wave signal satisfies a predetermined judgment condition.

The phase judgment circuit may include an n-stage shift register. And the powder presence/absence judgment circuit may include a logic gate that receives, as its input, output signals from the n-stage shift register.

The oscillator circuit may be a sweep oscillator circuit that sweeps a frequency of the output signal through a frequency range inclusive of a resonance frequency of the piezoelectric element.

It is to be noted that any arbitrary combination of the above-described structural components as well as the expressions according to the present invention changed among a system and so forth are all effective as and encompassed by the present aspects.

According to the aspects described above, as the second square wave signal does not transit from the initial level to the detection level when the first square wave signal rises or falls due to noise in a term out of the detection term, a misjudgment that may occur when a vibration or shock is applied can be reduced or eliminated, as compared with the prior art.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, the drawings in which.

DETAILED DESCRIPTION OF THE INVENTION

The invention will now be described based on the following embodiments which do not intend to limit the scope of the present invention but exemplify the invention. All of the features and the combinations thereof described in the embodiments are not necessarily essential to the invention.

Figure 1:
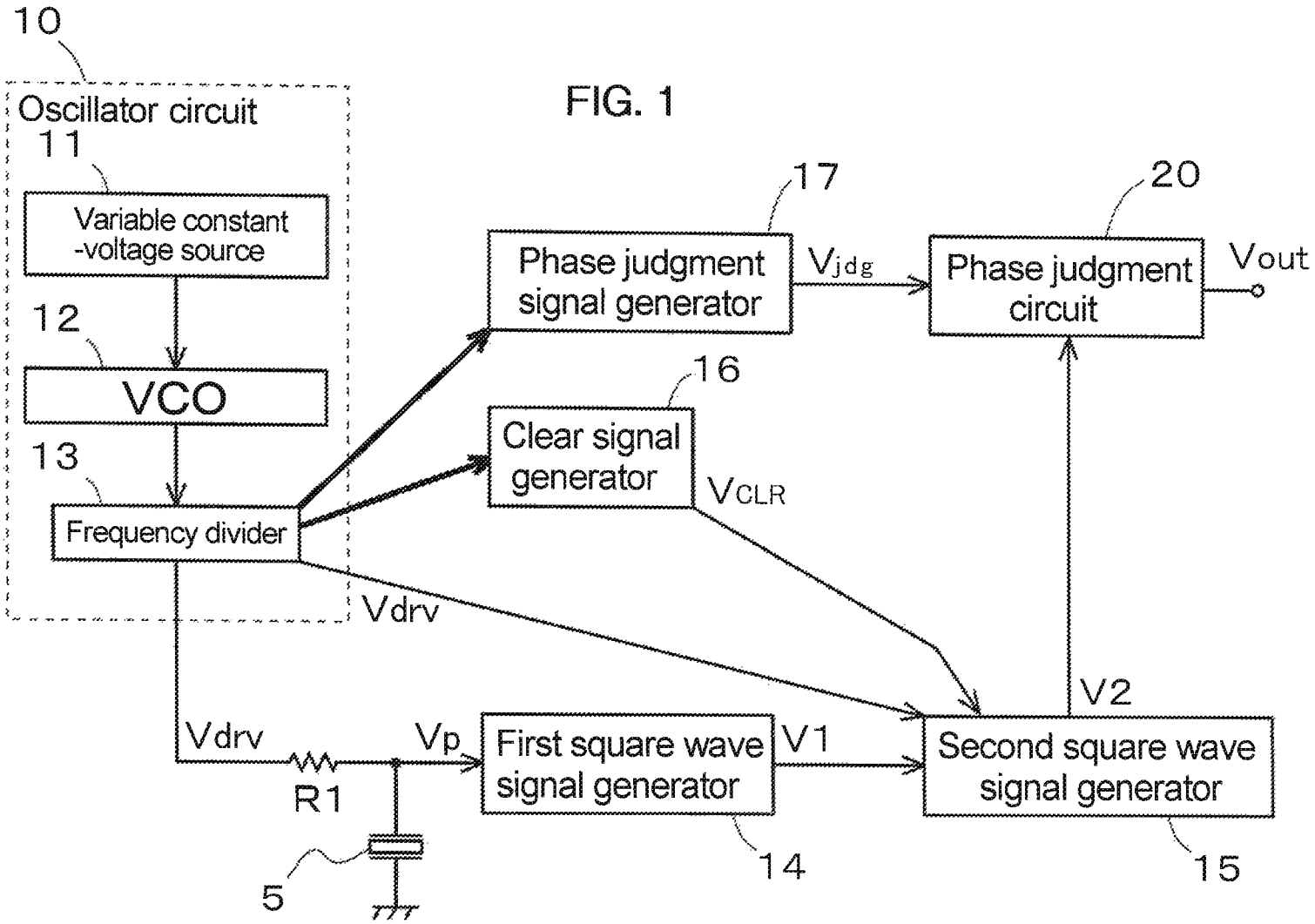
FIG. 1 is a block diagram of a toner sensor according to an embodiment of the present invention.
Figure 2:
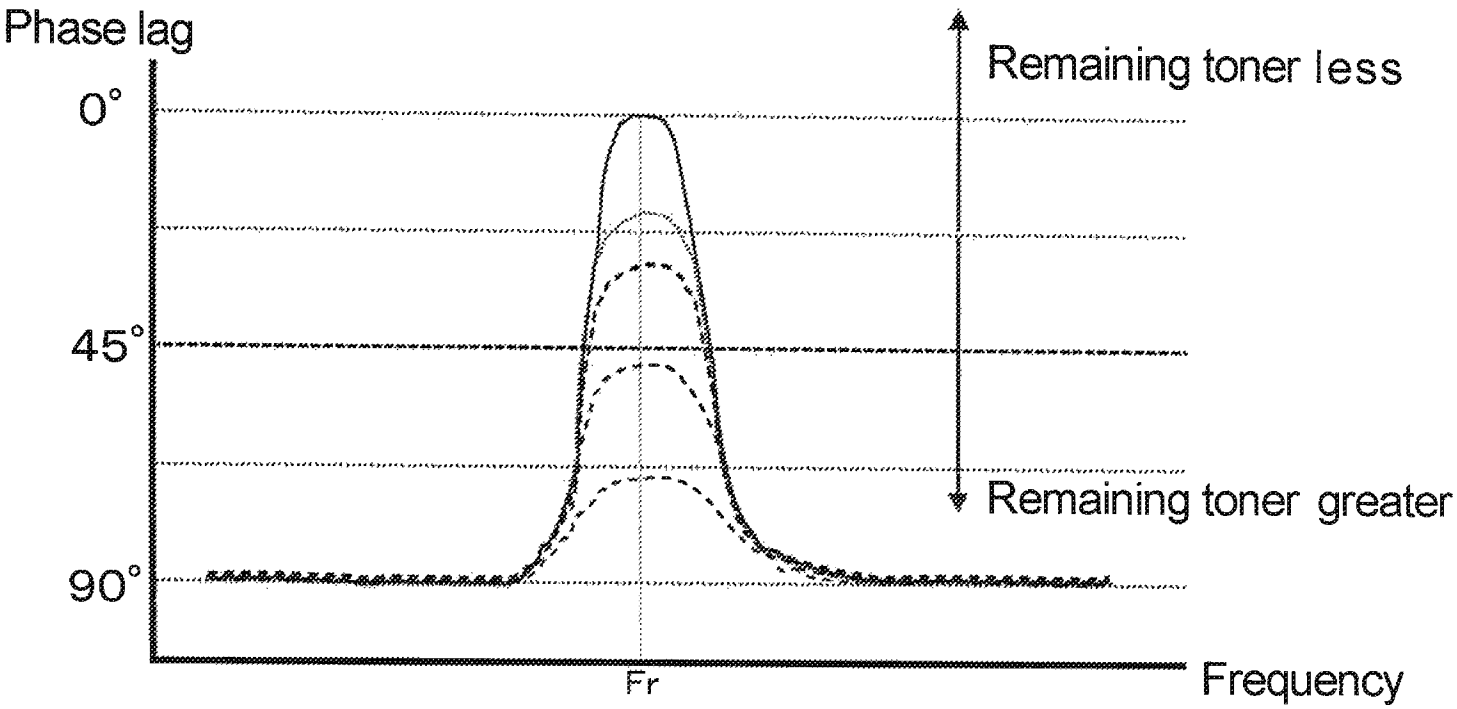
FIG. 2 is a phase lag characteristic diagram with respect to a frequency of an input signal of a piezoelectric element shown in FIG. 1.
Figure 3:
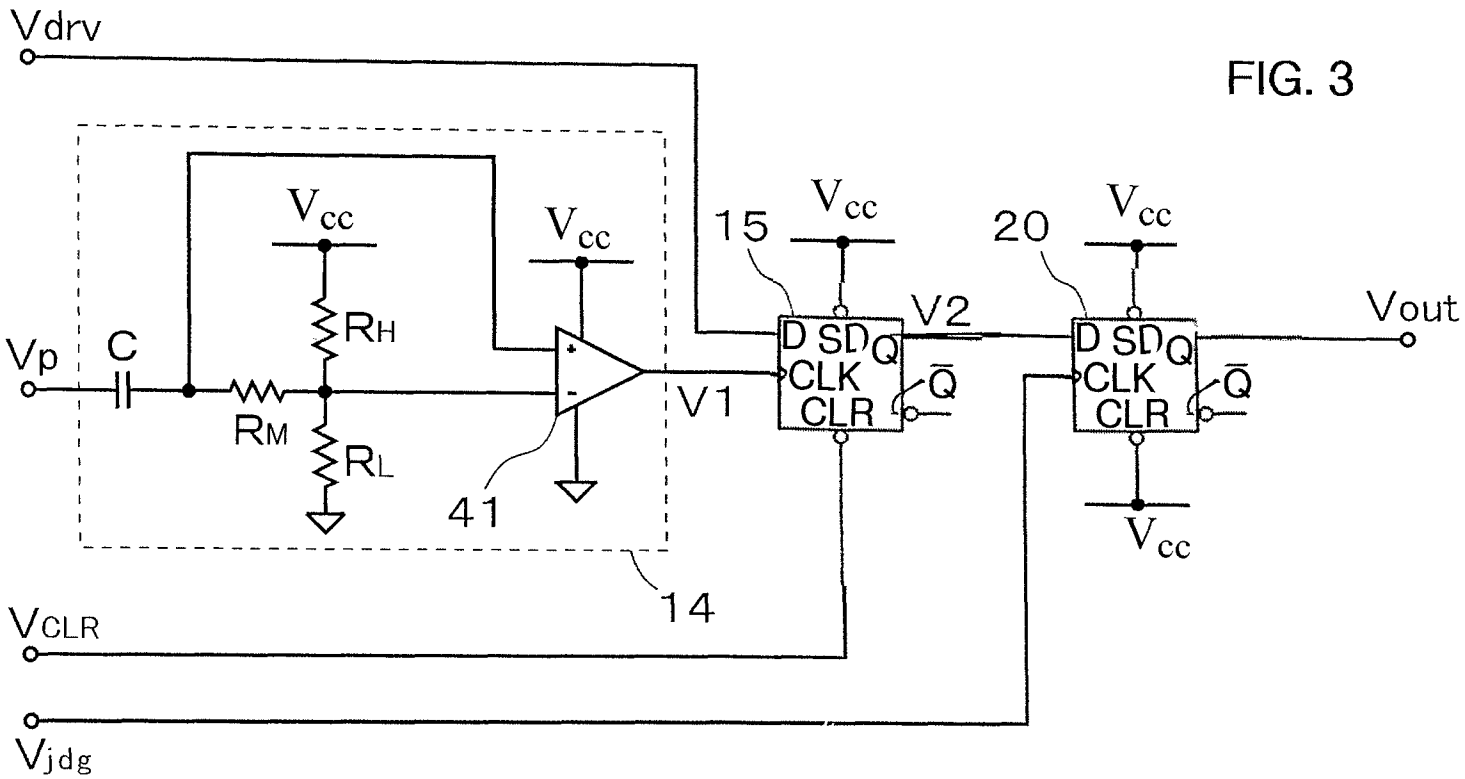
FIG. 3 is a circuit diagram showing exemplary specific configurations of a first square wave signal generator, a second square wave signal generator, and a phase judgment circuit.
Figure 4:
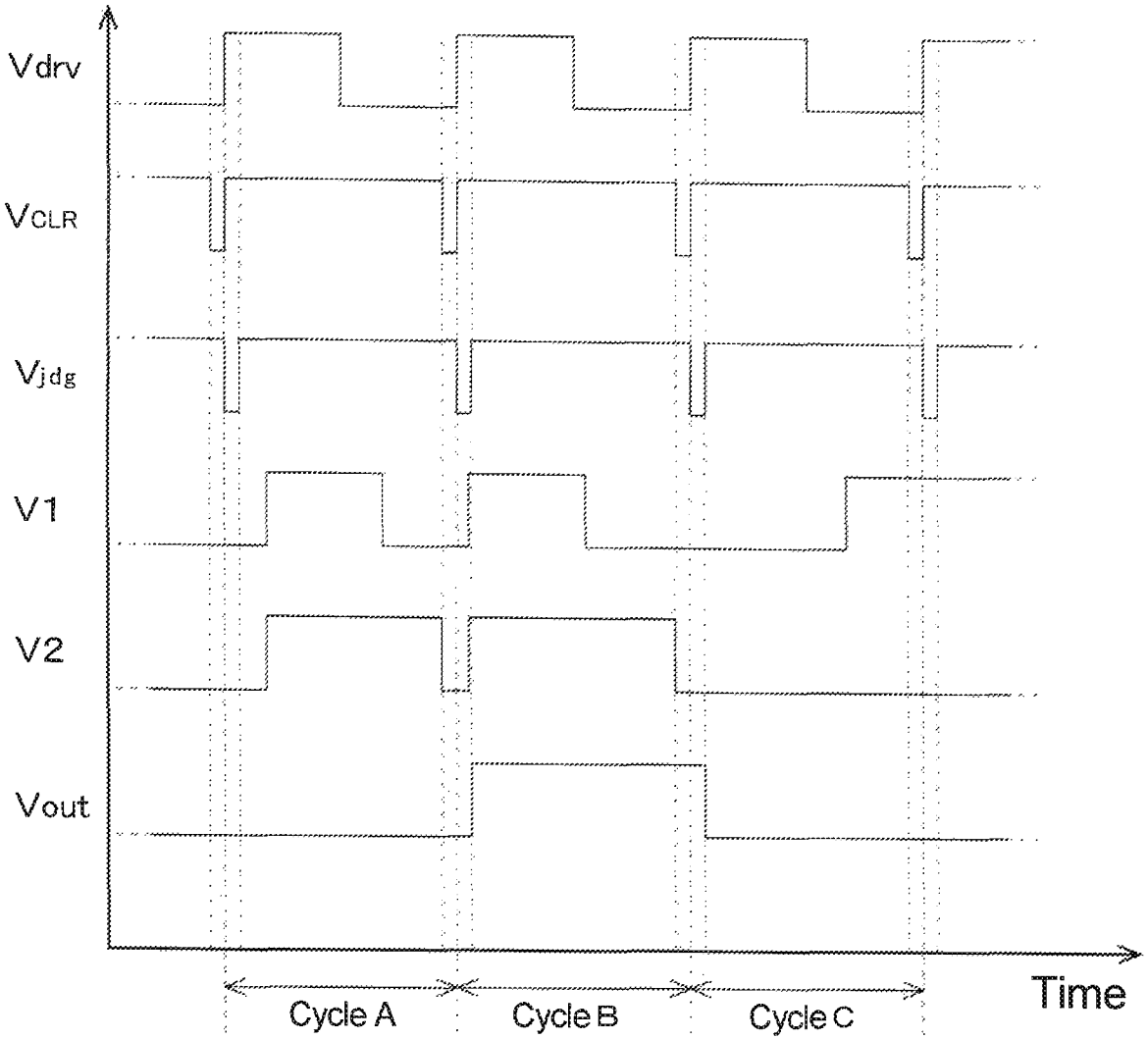
FIG. 4 is an exemplary time chart of each signal of FIG. 3.

FIG. 1 is a block diagram of a toner sensor as a powder sensor according to an embodiment of the present invention. FIG. 2 is a phase lag characteristic diagram of a piezoelectric element 5 shown in FIG. 1 with respect to a frequency of an input signal thereto. FIG. 3 is a circuit diagram showing exemplary specific configurations of a the first square wave signal generator 14, a the second square wave signal generator 15, and a phase judgment circuit 20. FIG. 4 is an exemplary time chart of each signal (each of an output signal Vdrv of an oscillator circuit 10, a clear signal $V_{CLR}$, a phase judgment signal $V_{jdg}$, a first square wave signal V1, a second square wave signal V2, and a sensor output signal Vout) of FIG. 3.

As shown in FIG. 1, the toner sensor includes a piezoelectric element 5, an oscillator circuit 10, a first square wave signal generator 14, a second square wave signal generator 15, a clear signal generator 16, a phase judgment signal generator 17, and a phase judgment circuit 20.

The piezoelectric element 5 is fitted to a toner box and has a phase lag relative to an input signal depending on the frequency of the input signal and the remaining amount of toner. Phase lag characteristics with respect to the input signal frequency are as shown in FIG. 2.

With respect to an input signal having a resonance frequency Fr, the piezoelectric element 5 has no phase shift since the piezoelectric element 5 becomes resonant due to its efficient inductance (L)-capacitance (C) energy exchange in the vicinity of the resonance frequency Fr. According as the input signal frequency goes away from the resonance frequency Fr, however, the piezoelectric element 5 comes to have a larger phase lag due to its increased capacitance characteristics. According as a greater amount of toner remains in the toner box, the oscillation of the piezoelectric element 5 is obstructed to a greater extent, resulting in increased capacitance characteristics even with respect to the input signal having the resonance frequency Fr or a frequency near the resonance frequency Fr. On the other hand, according as toner in the toner box approaches zero, the piezoelectric element 5 comes to have a remarkably reduced phase lag with respect to the input signal having the resonance frequency Fr or a frequency near the resonance frequency Fr.

The oscillator circuit 10 applies its output signal Vdrv (voltage signal) having a frequency equal to or near the resonance frequency Fr of the piezoelectric element 5 via a resistor (limiting resistor) R1 to the piezoelectric element 5. The oscillator circuit 10 preferably sweeps the frequency of the output signal Vdrv within a frequency range inclusive of the resonance frequency Fr of the piezoelectric element 5. Sweeping is effective when the resonance frequency of the piezoelectric element 5 fitted to the toner box cannot be accurately specified.

The oscillator circuit 10 includes a variable constant-voltage source 11, a voltage-controlled oscillator (VCO) 12, and a frequency divider 13. The voltage-controlled oscillator 12 is operated by a control voltage from the variable constant-voltage source 11. The frequency divider 13 divides an output signal from the voltage-controlled oscillator 12 at a predetermined frequency dividing ratio. The frequency dividing ratio is expressed by $2^k$ (k is an arbitrary natural number) for example and, in this variant, k is 4 or more (the frequency dividing ratio is 16 or more). If the frequency dividing ratio is $2^k$, the circuit can be simplified with enhanced efficiency, but it may be an arbitrary numerical value as long as it is an integer. The output signal Vdrv frequency-divided by the frequency divider 13 is applied via a resistor R1 to the piezoelectric element 5. By varying the voltage of the variable constant-voltage source 11, the frequency of the output signal Vdrv is swept over a frequency range including the resonance frequency Fr of the piezoelectric element 5.

The first square wave signal generator 14 generates the first square wave signal V1 by converting the terminal voltage Vp of the piezoelectric element 5 to a square wave signal (binary signal). The second square wave signal generator 15 receives the output signal Vdrv of the oscillator circuit 10, the clear signal $V_{CLR}$ mentioned below, and the first square wave signal V1, and then generates based on these signals the second square wave signal V2. The second square wave signal V2 transits from an initial level to a detection level when the first square wave signal V1 rises or falls (that is, taking a rising edge or a falling edge of the first square wave signal V1 as a trigger) only in a detection term which is a part of each cycle of the output signal Vdrv of the oscillator circuit 10.

In FIG. 1, while a single heavy line connects between the frequency divider 13 and the clear signal generator 16 and another single heavy line connects between the frequency divider 13 and the phase judgment signal generator 17, signals inputted from the frequency divider 13 to the clear signal generator 16 and the phase judgment signal generator 17 include, in addition to the output signal Vdrv, oscillation signals having frequencies which are e.g. 2 times, 4 times, 8 times, and 16 times as high as that of the output signal Vdrv. The clear signal generator 16 and the phase judgment signal generator 17 are well-known logic gates or combinations thereof and generate the clear signal $V_{CLR}$ and the phase judgment signal $V_{jdg}$ by logical operations using inputted signals from the frequency divider 13.

The phase judgment circuit 20 compares a phase of the phase judgment signal $V_{jdg}$ with a phase of the second square wave signal V2 and then judges whether the phase of the second square wave signal V2 is delayed or advanced relative to the phase of the phase judgment signal $V_{jdg}$. The judgment is done for example when the phase judgment signal $V_{jdg}$ rises, that is, taking a rising edge of the phase judgment signal $V_{jdg}$ as a trigger. A sensor output signal Vout of the phase judgment circuit 20 is a binary signal having different levels depending on whether the second square wave signal V2 has a phase lag or a phase lead relative to the phase judgment signal $V_{jdg}$. The sensor output signal Vout is updated in sequence every time the judgment is performed. Toner is judged to be present if the second square wave signal V2 has a phase lag relative to the phase judgment signal $V_{jdg}$, while toner is judged to be absent if the second square wave signal V2 has a phase lead relative to the phase judgment signal $V_{jdg}$.

As shown in FIG. 3, the first square wave signal generator 14 includes a comparator 41. Input to an inverting input terminal of the comparator 41 is a reference voltage obtained by dividing a power source voltage Vcc by resistors $R_H$ and $R_L$, at a voltage division ratio of 1:1 for example. Input to a non-inverting input terminal of the comparator 41 though a DC cut capacitor C is the terminal voltage Vp of the piezoelectric element 5. A resistor $R_M$ is between a junction of resistors $R_H$, $R_L$, and the non-inverting input terminal of the comparator 41. The first square wave signal V1 obtained by converting the terminal voltage Vp of the piezoelectric element 5 to a square wave is outputted from an output terminal of the comparator 41. While a little phase shift (phase lead) is caused by the DC cut capacitor C passing the terminal voltage Vp of the piezoelectric element 5, the phase shift can be small enough to be ignored if capacitance of the DC cut capacitor C is sufficiently large.

The second square wave signal generator 15 is for example a D-type flip-flop as an edge trigger type flip-flop whose clock input (input to a clock terminal) is the first square wave signal V1, whose D-input (input to a D terminal) is the output signal Vdrv of the oscillator circuit 10, whose clear input (input to a clear terminal) is the clear signal $V_{CLR}$, and which outputs the second square wave signal V2 from a Q terminal.

The second square wave signal V2 transits from a low level as an initial level to a high level as an detection level when the first square wave signal V1 rises only in a term (example of an detection term) wherein the output signal Vdrv of the oscillator circuit 10 is in a high level as a first level (see cycle A, B in FIG. 4). On the other hand, in a term wherein the output signal Vdrv of the oscillator circuit 10 is in a low level as a second level (that is, in a term out of the detection term), the second square wave signal V2 does not transit even if the first square wave signal V1 rises (see cycle C in FIG. 4). That is, the output signal Vdrv of the oscillator circuit 10 functions as a detection term limiting signal.

The clear signal $V_{CLR}$ sets an output of the Q terminal of the second square wave signal generator 15 (the second square wave signal V2) to a low level (the initial level) before beginning of the detection term of a next cycle, that is, before next rising of the output signal Vdrv of the oscillator circuit 10. As shown in FIG. 4, the clear signal $V_{CLR}$ is a pulse signal which falls when the output signal Vdrv of the oscillator circuit 10 is in a predetermined angle (e.g. approximately 350°) of each cycle and rises in the end of each cycle. Note that timing when the clear signal $V_{CLR}$ falls in each cycle is not limited as long as the timing is after the phase judgment signal $V_{jdg}$ rises.

The phase judgment circuit 20 has for example a D-type flip-flop as an edge trigger type flip-flop whose D-input is the second square wave signal V2, whose clock input is the phase judgment signal $V_{jdg}$, and which outputs the sensor output signal Vout from a Q terminal.

As shown in FIG. 4, the phase judgment signal $V_{jdg}$ is for example a pulse signal which rises a predetermined angle (e.g. 11.25°) after the output signal Vdrv of the oscillator circuit 10 rises. While fall timing of the phase judgment signal $V_{jdg}$ is equal to rise timing of the output signal Vdrv of the oscillator circuit 10 in FIG. 4, the fall timing is not limited.

The sensor output signal Vout becomes the same level as the second square wave signal V2 which is the D-input thereof when the phase judgment signal $V_{jdg}$ rises and then keep the same level by the next time when the phase judgment signal $V_{jdg}$ rises (see cycle B in FIG. 4). As mentioned above, the second square wave signal V2 is made low level by the end of each cycle. Therefore, the sensor output signal Vout becomes or keeps high level when the phase judgment signal $V_{jdg}$ rises only in the case where the second square wave signal V2 rises before the phase judgment signal $V_{jdg}$ rises in each cycle (namely, in the case where a phase lag of the second square wave signal V2 relative to the output signal Vdrv of the oscillator circuit 10 is within a predetermined angle, for example 11.25°). High level of the sensor output signal Vout corresponds to toner absence and low level thereof corresponds to toner presence.

The embodiment is effective to prevent a misjudgment due to long-term noise, which is difficult for the prior art to prevent. The long-term noise causes the terminal voltage Vp of the piezoelectric element 5 to be high during a term longer than a cycle of the output signal Vdrv of the oscillator circuit 10. In other words, the long-term noise is that the amplitude thereof is large and the frequency thereof is lower than that of the output signal Vdrv of the oscillator circuit 10. If the long-term noise is applied, the first square wave signal V1 keeps high level during a plurality of cycles. A misjudgment caused by the long-term noise is explained below referring a comparative example shown in FIG. 8. In the comparative example, the second square wave signal generator 15 in FIG. 3 is removed and an input to the D-input of the D-type flip-flop of the phase judgment circuit 20 is changed to the first square wave signal V1. If the first square wave signal V1 keeps high level during a plurality of cycles due to the long-term noise applied, the sensor output signal Vout becomes high level (indicates toner absence) when the phase judgment signal $V_{jdg}$ rises even if toner is present, in the comparative example shown in FIG. 8. On the other hand, in a circuit of the embodiment shown in FIG. 3, as long as the first square wave signal V1 rises after the phase judgment signal $V_{jdg}$ rises in each cycle, even if the first square wave signal V1 keeps high level during a plurality of cycles, the second square wave signal V2 does not become high level before the phase judgment signal $V_{jdg}$ rises in each cycle. Therefore, the sensor output signal Vout also does not become high level.

Figure 5:
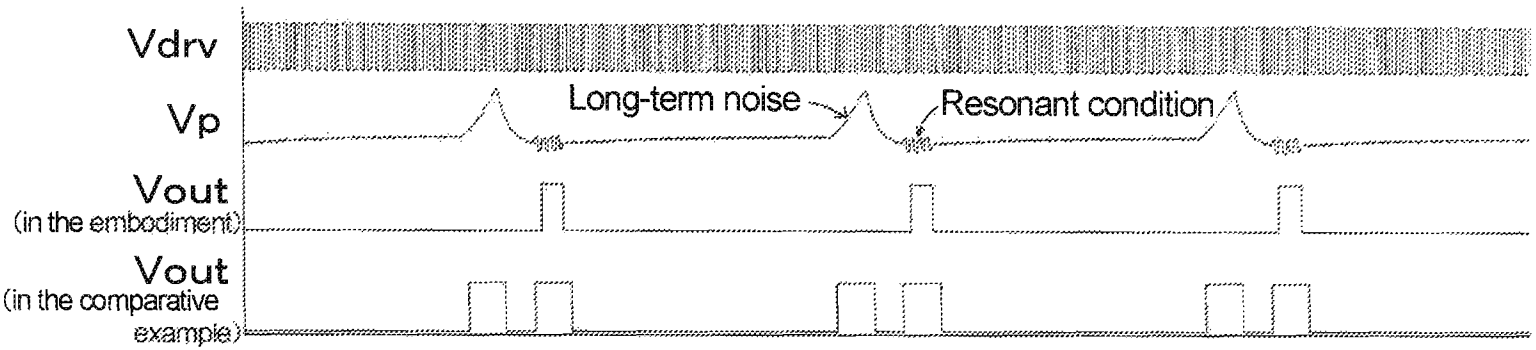
FIG. 5 is a time chart showing a result of a simulation in circuits of FIG. 3 and FIG. 8 (a comparative example).
Figure 8:
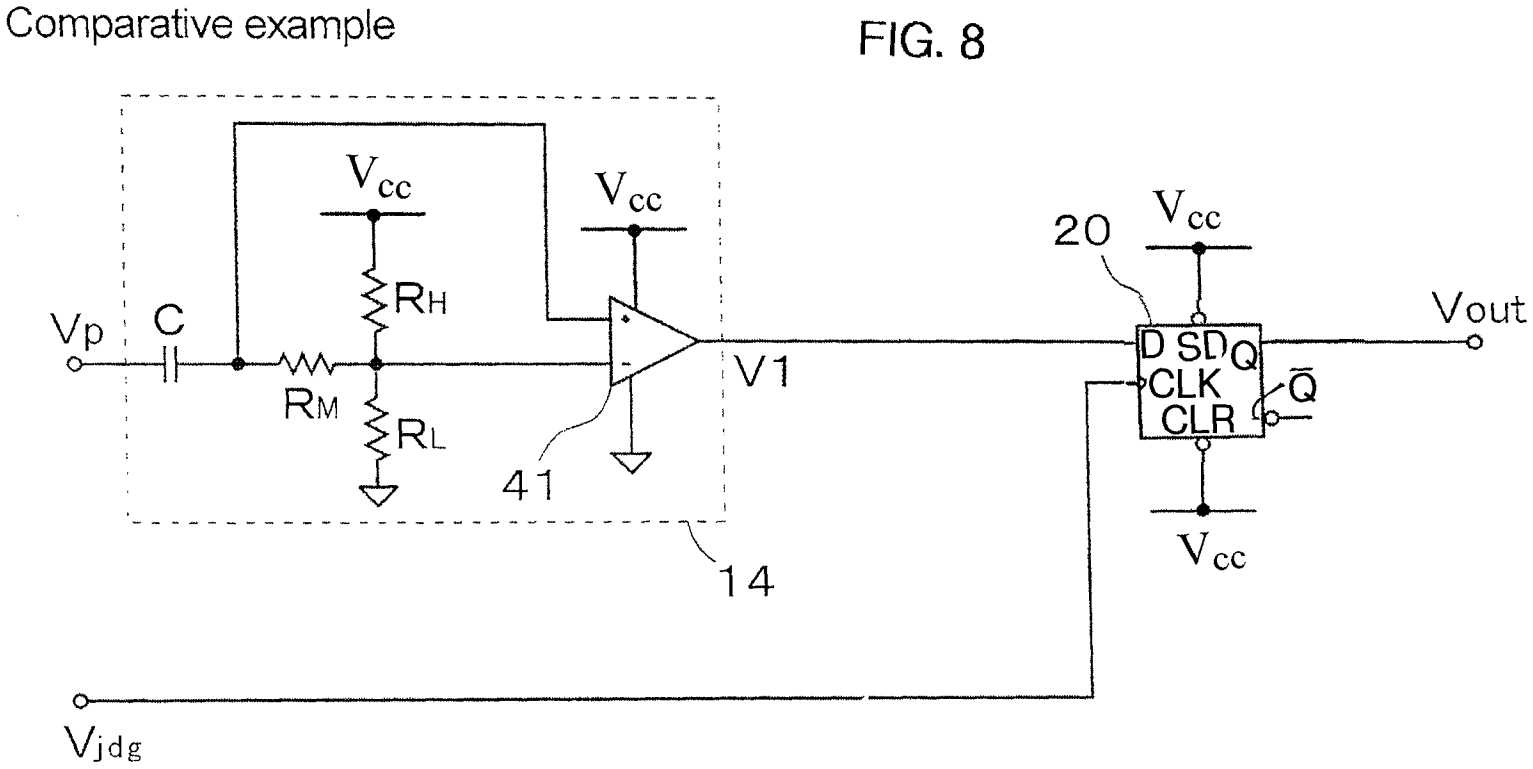
FIG. 8 is a circuit diagram of a comparative example with respect to FIG. 3.

FIG. 5 is a time chart showing a result of a simulation in circuits of FIG. 3 and FIG. 8 (a comparative example). The simulation assumes waveforms of the output signal Vdrv of the oscillator circuit 10 and the terminal voltage Vp of the piezoelectric element 5, and then aims to see how the sensor output signal Vout is in the circuits of FIG. 3 and FIG. 8 (a comparative example). Note that, in FIG. 5, the waveform of the terminal voltage Vp of the piezoelectric element 5 shows both resonant condition of toner absence and the long-term noise.

As is clear from FIG. 5, in the circuit of the embodiment (FIG. 3), the sensor output signal Vout does not transit from low level even if the long-term noise is applied, and then a misjudgment is prevented. On the other hand, in the circuit of the comparative example (FIG. 8), the sensor output signal Vout transits to high level when the long-term noise is applied, which causes a misjudgment. Note that toner absence can be detected by both the embodiment and the comparative example in the resonant condition, because the sensor output signal Vout transits to high level.

According to this embodiment, the following effects can be presented.

(1) As long as a rising of the first square wave signal V1 due to noise is during the output signal Vdrv of the oscillator circuit 10 is low level in each cycle, influence of the noise is blocked by the second square wave signal generator 15 (the influence of the noise does not appear in the second square wave signal V2). Therefore, a misjudgment is prevented even if the first square wave signal V1 keeps high level during a plurality of cycles due to the noise, and a toner sensor capable of reducing or eliminating a misjudgment that may occur when a vibration or shock is applied, as compared with the prior art.

(2) Even if a rising of the first square wave signal V1 is during the output signal Vdrv of the oscillator circuit 10 is high level in each cycle, as long as the rising of the first square wave signal V1 is after a rising of the phase judgment signal $V_{jdg}$, influence of the noise is blocked by the phase judgment circuit 20 (the influence of the noise does not appear in the sensor output signal Vout). Therefore, a misjudgment is prevented. In this case, even if the first square wave signal V1 is caused to be high level during a plurality of cycles due to noise, as the second square wave signal V2 is made low level by the end of each cycle, a misjudgment due to the noise is prevented. That is, influence of a long-term noise extending a plurality of cycles appears only in a first cycle of the second square wave signal V2, but does not appear in cycles after the first cycle, then the misjudgment is prevented. Therefore, most of the misjudgments due to a long-term noise, which is difficult for the prior art to prevent, are preferably prevented.

(3) Since the phase comparison and the toner presence/absence judgment are digitally processed, there is no need to consider the frequency components of the noise (impulse wave). Therefore, the misjudgment can be prevented even on the condition that the frequency components of an external noise overlap with and cannot be discriminated from the resonance frequency of the piezoelectric element 5 due to the shape of the piezoelectric element 5.

(4) Since the major part is composed of digital circuits with reduced number of discrete components such as capacitors and resistors, this embodiment is suitable for the IC configuration and advantageous for the cost reduction.

Hereafter, the other embodiment is explained which can prevent a misjudgment even in the case where a rising of the first square wave signal V1 due to a long-term noise is before a rising of the phase judgment signal $V_{jdg}$ in a cycle.

Figure 6:
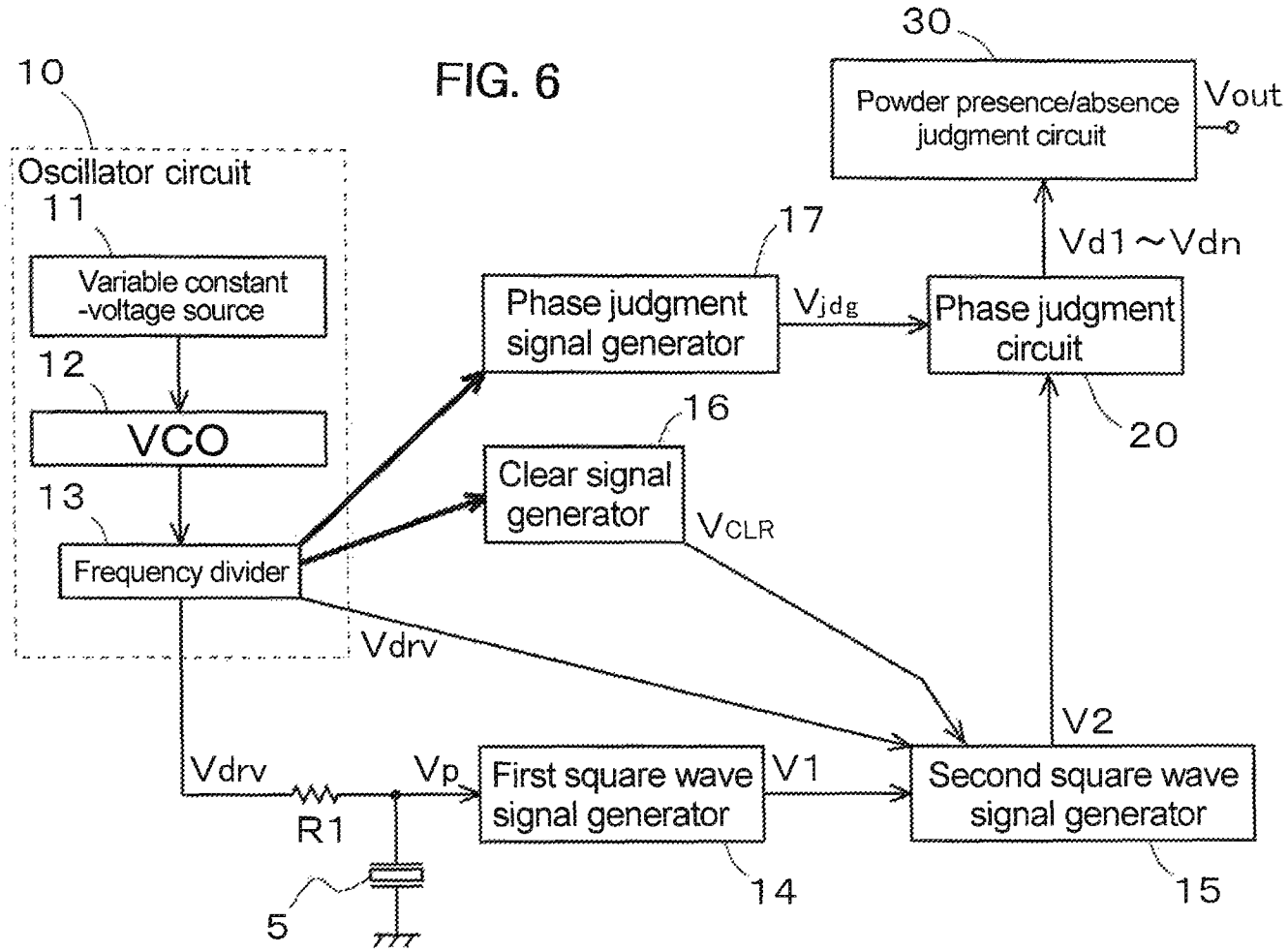
FIG. 6 is a block diagram of a toner sensor according to another embodiment of the present invention.

FIG. 6 is a block diagram of a toner sensor as a powder sensor according to the other embodiment of the present invention. FIG. 6 is differs from FIG. 1 in the point that the toner sensor has a powder presence/absence judgment circuit 30 and the sensor output signal Vout is outputted from the powder presence/absence judgment circuit 30, and is the same as FIG. 1 in the other points. Hereafter, the different points is mainly explained.

The phase judgment circuit 20 retains results of most recent n ("n" is any integer satisfying n≥2) consecutive comparisons (results of comparing a phase of the phase judgment signal $V_{jdg}$ and a phase of the second square wave signal V2) as phase judgment result signals Vd1 to Vdn. The phase judgment result signals Vd1 to Vdn are inputted from the phase judgment circuit 20 to the powder presence/absence judgment circuit 30. The phase comparison result signals Vd1 to Vdn are each a binary signal having different levels depending on whether the second square wave signal V2 has a phase lag or a phase lead relative to the phase judgment signal $V_{jdg}$ (depending on whether a predetermined condition is satisfied or not) and, every time the comparison is performed, are updated in sequence.

Based on the input phase comparison result signals Vd1 to Vdn, the powder presence/absence judgment circuit 30 judges the presence/absence of toner in the toner box. Specifically, the powder presence/absence judgment circuit 30 judges toner to be absent under the condition that all of the phase comparison result signals Vd1 to Vdn indicate the phase lead of the second square wave signal V2 relative to the phase judgment signal $V_{jdg}$ (and issues the sensor output signal Vout having a level different from that when the condition is not satisfied). In other words, the powder presence/absence judgment circuit 30 makes a judgment that toner is absent if the phase judgment circuit 20 detects n consecutive times that there is a phase lead of the second square wave signal V2 relative to the phase judgment signal $V_{jdg}$.

Figure 7:
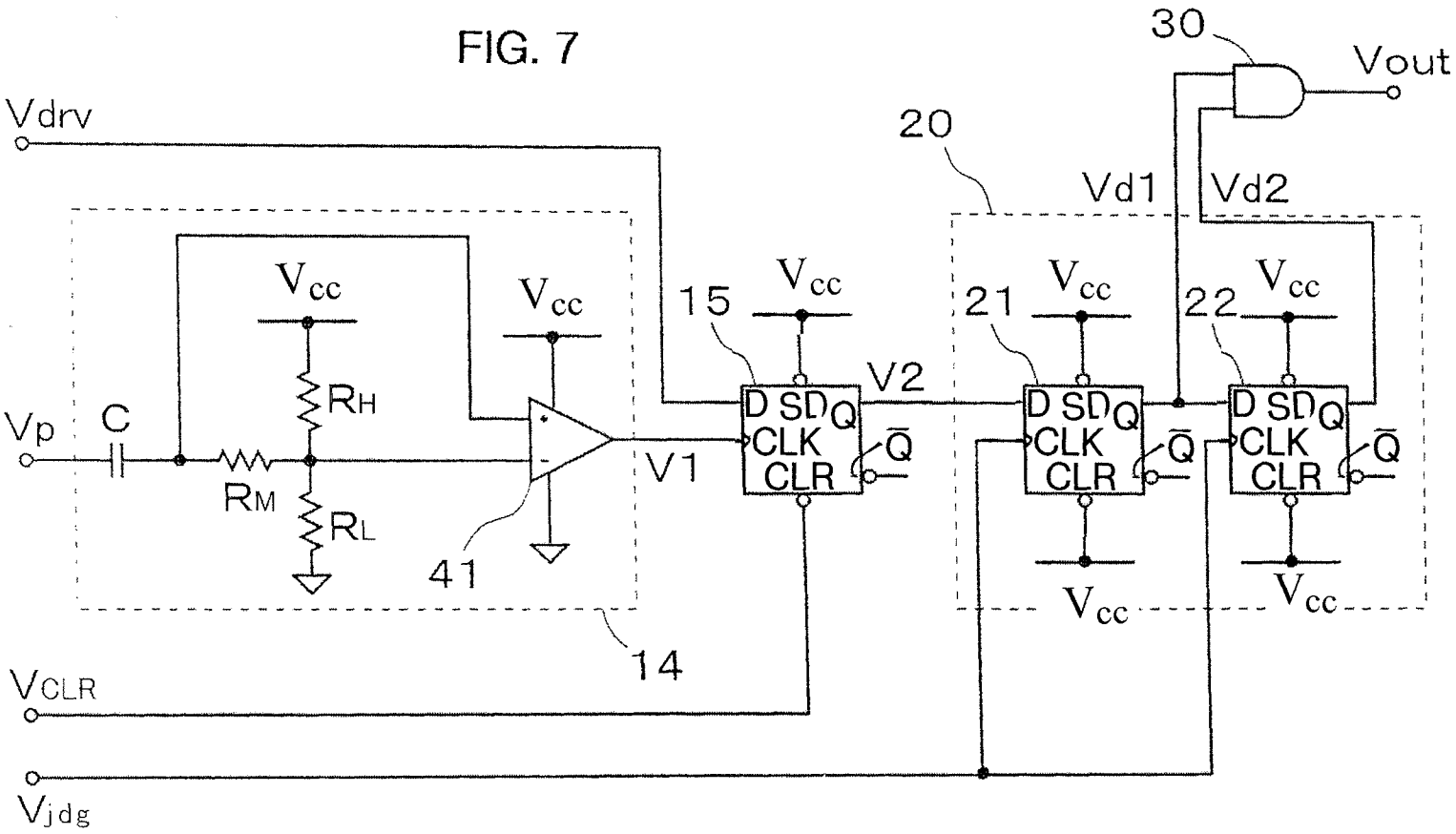
FIG. 7 is a circuit diagram showing exemplary specific configurations of a first square wave signal generator, a second square wave signal generator, a phase judgment circuit and a powder presence/absence judgment circuit shown in FIG. 6 in the case of n=2.

FIG. 7 is a circuit diagram showing exemplary specific configurations of the first square wave signal generator 14, the second square wave signal generator 15, the phase judgment circuit 20 and the powder presence/absence judgment circuit 30 shown in FIG. 6 in the case of n=2. Different points of FIG. 7 from FIG. 3 are mainly explained hereafter.

The phase judgment circuit 20 has D-type flip-flops 21, 22 making up a two-stage shift register. The powder presence/absence judgment circuit 30 is a two-input AND gate. The second square wave signal V2 is inputted to a D-input terminal of the first stage D-type flip-flop 21. A Q-output terminal of the first stage D-type flip-flop 21 is connected to a D-input terminal of the second D-type flip-flop 22. CLK terminals of the D-type flip-flops 21, 22 each receive the phase judgment signal $V_{jdg}$. Q-output terminals of the D-type flip-flops 21, 22 are each connected to input terminals of the powder presence/absence judgment circuit 30, the two-input AND gate.

According to the above circuit configuration, the D-type flip-flops 21, 22 store in sequence the level of the second square wave signal V2 at the time of each of two consecutive rises (level transitions from low to high) of the phase judgment signal $V_{jdg}$, and output the levels as the phase comparison result signals Vd1, Vd2 from the Q-output terminals. Thus, the uppermost stage D-type flip-flop 21 of the shift register functions as a phase comparator circuit, and the comparison results at the D-type flip-flop 21 are shifted in sequence, for each rise of the phase judgment signal $V_{jdg}$, to the subsequent stage D-type flip-flop 22 for the storage and output. When all of the voltages at the Q-output terminals of the D-type flip-flops 21, 22 are high level, the powder presence/absence judgment circuit 30 sets the sensor output signal Vout high level, whereas when at least one of the voltages at the Q-output terminals of the D-type flip-flops 21, 22 is low level, the powder presence/absence judgment circuit 30 sets the sensor output signal Vout low level.

In the other embodiment, if a rising of the first square wave signal V1 due to a long-term noise is before a rising of the phase judgment signal $V_{jdg}$ in each cycle, one of the phase comparison result signals Vd1, Vd2 from the D-type flip-flops 21, 22 becomes high level, but the other is low level, because the second square wave signal V2 is made low level by the end of each cycle. Therefore, the sensor output signal Vout remains low level. That is, the other embodiment can further reduce a misjudgment, compared with the circuit in FIG. 3.

Described above is an explanation based on the embodiment. The description of the embodiments is illustrative in nature and various variations in constituting elements and processes involved are possible. Those skilled in the art would readily appreciate that such variations are also within the scope of the present invention.

The D-input of the second square wave signal generator 15 may be a detection term limiting signal other than the output signal Vdrv of the oscillator circuit 10 as long as the detection term limiting signal is a pulse signal which is high level during a term between a rising of the output signal Vdrv of the oscillator circuit 10 and a rising of the phase judgment signal $V_{jdg}$. If the D-input of the second square wave signal generator 15 is a detection term limiting signal which transits to low level just after a rising of the phase judgment signal $V_{jdg}$, a noise influence is more effectively eliminated in the second square wave signal generator 15.

The value of "n" in the other embodiment may be properly set depending on required specifications.

Toner to be detected is not limited to the toner exemplified in the embodiment and the variant.

What is claimed is:

1. A powder sensor comprising:

a piezoelectric element;

an oscillator circuit that applies to the piezoelectric element an output signal having a frequency equal to or near a resonance frequency of the piezoelectric element;

a first square wave signal generator that generates a first square wave signal by converting a terminal voltage of the piezoelectric element into the first square wave signal;

a second square wave signal generator that generates a second square wave signal that transits from an initial level to a detection level when the first square wave signal rises or falls in a period during which the output signal of the oscillator circuit is at a first level and that does not transit from the initial level to the detection level when the first square wave signal rises or falls in a period during which the output signal of the oscillator circuit is at a second level;

a clear signal generator that generates a clear signal and inputs the clear signal to the second square wave signal generator to set the second square wave signal to the initial level after the output signal of the oscillator circuit transits from the first level to the second level and before the output signal of the oscillator circuit subsequently transits from the second level to the first level;

a phase judgment signal generator that generates a phase judgment signal which makes a predetermined level transition at a predetermined phase angle after the output signal of the oscillator circuit transits from the second level to the first level; and a phase judgment circuit that determines whether the second square wave signal has a phase lag or a phase lead relative to the phase judgment signal, wherein the second square wave signal generator comprises an edge trigger D flip-flop having a clock input receiving the first square wave signal, a D-input receiving the output signal of the oscillator circuit, and a clear input receiving the clear signal.

2. The powder sensor according to claim 1 comprising a powder presence/absence judgment circuit that determines whether powder is present or absent based on the phase lead or phase lag determined by the phase judgment circuit, wherein the powder presence/absence judgment circuit makes a determination that powder is absent if the phase judgment circuit detects, n consecutive times (where "n" is an integer and n>2), that the phase of the second square wave signal satisfies one of the phase lead or the phase lag relative to the phase judgment signal.

3. The powder sensor according to claim 2, wherein the phase judgment circuit comprises an n-stage shift register, and the powder presence/absence judgment circuit comprises a logic gate that receives, as an input, output signals from the n-stage shift register.

4. The powder sensor according to claim 1, wherein the oscillator circuit is a sweep oscillator circuit that sweeps the frequency of the output signal through a frequency range inclusive of a resonance frequency of the piezoelectric element.

5. The powder sensor according to claim 1, wherein the phase judgment circuit comprises an edge trigger D flip-flop having a clock input receiving the phase judgment signal and a D-input receiving the second square wave signal.

* * * * *